US008651758B2

(12) United States Patent
Nagao et al.

(10) Patent No.: US 8,651,758 B2
(45) Date of Patent: Feb. 18, 2014

(54) EXTERIOR STRUCTURE OF APPARATUS AND IMAGE FORMING APPARATUS USING THE SAME

(75) Inventors: Hiroyuki Nagao, Nara (JP); Takashi Kikutani, Nara (JP); Kazuhisa Yoneda, Nara (JP); Yasushi Nakamura, Yamatokoriyama (JP); Toshikazu Kitaura, Kashihara (JP); Hidenobu Mandai, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 1624 days.

(21) Appl. No.: 11/766,135

(22) Filed: Jun. 21, 2007

(65) Prior Publication Data

US 2008/0043443 A1 Feb. 21, 2008

(30) Foreign Application Priority Data

Jul. 5, 2006 (JP) ..... 2006-185132

(51) Int. Cl.
*B41J 29/377* (2006.01)

(52) U.S. Cl.
USPC ..... 400/693

(58) Field of Classification Search
CPC ..... G03G 2221/1678; H05K 5/0213; H05K 5/20; B41J 29/377
USPC ..... 400/693; 454/184
IPC ..... B41J 29/377
See application file for complete search history.

(56) References Cited

U.S. PATENT DOCUMENTS

| | | | | |
|---|---|---|---|---|
| 2,308,262 | A * | 1/1943 | Beil | 49/38 |
| 5,317,367 | A * | 5/1994 | Pierce et al. | 399/38 |
| 6,735,079 | B2 * | 5/2004 | Huang | 361/695 |
| 2006/0148399 | A1 * | 7/2006 | Su | 454/184 |

FOREIGN PATENT DOCUMENTS

| | | | |
|---|---|---|---|
| JP | 01-321447 | | 12/1989 |
| JP | 2001194967 | A * | 7/2001 |

* cited by examiner

*Primary Examiner* — Judy Nguyen
*Assistant Examiner* — Jennifer Simmons
(74) *Attorney, Agent, or Firm* — Renner, Otto, Boisselle & Sklar, LLP

(57) ABSTRACT

An exterior structure of an apparatus for covering the outside of an apparatus main body with a multiple number of panel elements uses shielding panels, heat-radiating panels and machine-interior anti-scatter panels as the multiple number of panel elements. The apparatus has a framework to which shielding panels, heat-radiating panels and machine-interior anti-scatter panels are appropriately arranged in combination to cover the apparatus in conformity with the functional configuration of the apparatus.

8 Claims, 15 Drawing Sheets

EXTERIOR STRUCTURE OF APPARATUS AND IMAGE FORMING APPARATUS USING THE SAME

This Nonprovisional application claims priority under 35 U.S.C. §119(a) on Patent Application No. 2006-185132 filed in Japan on 5 Jul. 2006, the entire contents of which are hereby incorporated by reference.

BACKGROUND OF THE INVENTION (1) Field of the Invention

The present invention relates to an exterior structure of an apparatus and an image forming apparatus using the same and in particular, relates to an exterior structure for ventilation and radiation of heat building up inside an apparatus having driving assemblies and heat sources as well as to an image forming apparatus using this exterior structure.

(2) Description of the Prior Art

One of the purposes of the exterior of an apparatus is to prevent the user from directly touching the driving assemblies, heat sources and other parts inside the machine and is designed in pursuit of aesthetical improvement of the apparatus appearance and its functions.

As one of generally known exterior structures of an apparatus, there is a configuration of an exterior 500 for a document reader as shown in FIGS. 1 and 2, for example, in which one-piece panel-like member 510 is fixed to the apparatus frame (not shown) by screws or by other fitting methods. In the drawings, designated at 510*b* are attachment holes for fixing screws.

Also, when there is a heat source or a source of scattering inside the machine, an exhaust port (ventilation hole) 510*c* is formed in a part of the exterior and a fan, filter and/or the like are disposed so as to reduce the interior temperature of the machine as well as to collect the scattered particles.

For example, as the prior art there has been a proposal of an image forming apparatus having a driving assembly and heat source such as a fixing unit and the like, in which passages for conducting cooling air inside the apparatus are formed between exterior panels so that cooling air and floating dust and the like inside the apparatus can be discharged out of the apparatus as a whole by way of a dust filter by an exhauster from the apparatus bottom (patent document 1: Japanese Patent Application Laid-open Hei 01-321447).

However, when a plurality of heat sources and sources of scattering as above exist inside the apparatus, each source should be connected to a duct so as to draw and convey heat and collect waste particles, hence this configuration will make the apparatus become large and have the exterior configuration complicated due to duct arrangement.

SUMMARY OF THE INVENTION

The present invention has been devised in view of the above conventional problems, it is therefore an object of the present invention to provide an exterior structure of an apparatus which has a simple configuration and can efficiently dissipate heat that has built up inside the apparatus to inhibit increase in the temperature inside the machine and can also efficiently remove machine interior contamination due to contaminants as well as to provide an image forming apparatus using this exterior structure.

The exterior structure of an apparatus according to the present invention and an image forming apparatus using this for solving the above problems are configured as follows.

The first aspect of the present invention resides in an exterior structure of an apparatus for covering the outside of an apparatus main body with a multiple number of panel elements, characterized in that the multiple panel elements include different types of panel elements, and the different types of panel elements are arranged in combination in accordance with the functional configuration of the apparatus main body.

An exterior structure of an apparatus according to the second aspect of the present invention is characterized in that, in addition to the configuration described in the first aspect, the functional configuration of the apparatus main body includes a function of radiating heat from a heat source inside the apparatus main body or a function of collecting floating contaminants inside the apparatus main body.

An exterior structure of an apparatus according to the third aspect of the present invention is characterized in that, in addition to the configuration described in the first or second aspect, a framework suited to the configuration of the panel elements is arranged between the apparatus main body and the panel elements.

An exterior structure of an apparatus according to the fourth aspect of the present invention is characterized in that, in addition to the configuration described in any one of the first through third aspects, the multiple types of panel elements at least include a shielding panel element, a heat-radiating panel element and a floating contaminant collecting panel element.

An exterior structure of an apparatus according to the fifth aspect of the present invention is characterized in that, in addition to the configuration described in the fourth aspect, the shape of the shielding panel element and that of the heat-radiating panel element are the same, and the heat-radiating panel element includes an air blower and at least has a ventilating hole formed on the panel element wall opposing the air blower.

An exterior structure of an apparatus according to the sixth aspect of the present invention is characterized in that, in addition to the configuration described in the fourth aspect, the shape of the shielding panel element and that of the floating contaminant collecting panel are the same, and the floating contaminant collecting panel includes an air blower and a contaminant collecting filter and at least has a ventilating hole formed on the panel element wall opposing the air blower or the contaminant collecting filter.

An exterior structure of an apparatus according to the seventh aspect of the present invention is characterized in that, in addition to the configuration described in the fifth or sixth aspect, the air blower is a suctioning fan or exhaust fan.

An exterior structure of an apparatus according to the eighth aspect of the present invention is characterized in that, in addition to the configuration described in any one of the first through seventh aspects, the multiple panel elements are arranged so that clearances that establish communication between the interior and exterior of the apparatus are created between adjacent panel elements.

An exterior structure of an apparatus according to the ninth aspect of the present invention is characterized in that, in addition to the configuration described in the eighth aspect, the clearance is formed with an inclination to the normal of the panel element surface.

That is, the clearance is formed so as to establish communication between the interior and exterior of the apparatus in an inclined manner, for example, including configurations that are vertically inclined and horizontally inclined with respect to the normal of the panel element surface.

The tenth aspect of the present invention resides in an image forming apparatus for producing image output in accordance with a print request, comprising: an apparatus main body; and, an exterior structure for covering the outside of the apparatus main body, characterized in that the apparatus main body includes: an image forming portion having an electrostatic latent image support on which a developer image is formed with a developer; a transfer unit for transferring the developer image onto a recording medium; a fixing unit for fixing the developer image transferred on the recording medium to the recording medium; and a conveyor portion for conveying and discharging the recording medium with the developer image fixed thereon, and the exterior structure is the exterior structure of an apparatus according to any one of the configurations defined in the above first to ninth aspects.

An image forming apparatus according to the eleventh aspect of the present invention is characterized in that, in addition to the configuration described in the tenth aspect, the multiple types of panel elements at least include a shielding panel element and a heat-radiating panel element, and, the heat-radiating panel element is disposed, at least, at a position corresponding to one selected from a group of components including: a heat generating portion of the fixing unit; a radiating portion of a power source board; the conveyor portion for conveying and discharging the recording medium that has been print processed; and a light source portion of a document reader.

An image forming apparatus according to the twelfth aspect of the present invention is characterized in that, in addition to the configuration described in the tenth or eleventh aspect, the multiple types of panel elements at least include a shielding panel element and a floating contaminant collecting panel element, and the floating contaminant collecting panel element is disposed, at least, at a position corresponding to the area where toner scatter of the developing portion in the image forming portion occurs or a cleaning portion of the process unit for forming images is located.

In accordance with the first aspect of the present invention, it is possible to construct the exterior of an apparatus in a simple manner, and it is also possible to change the layout of the exterior simply in conformity with the functional configuration of the apparatus.

For example, each panel element is provided in the form of a panel that can be removably attached alone, or in a so-called "slide panel" form. Panel elements having different functions are appropriately used in combination in accordance with the functional configuration of the apparatus. This arrangement makes it possible to efficiently dissipate heat that has built up inside the apparatus to inhibit increase in the temperature inside the machine and also efficiently remove machine interior contamination due to contaminants.

In accordance with the second to ninth aspects of the invention, the following effects can be obtained in addition to the common effect obtained from the invention defined in the first aspect.

That is, according to the second aspect of the invention, it is possible to provide a function of dissipating heat from the heat source and a function of collecting floating contaminants in a simple manner by appropriately arranging panel elements having different functions in combination in accordance with the functional configuration.

According to the third aspect of the invention, in addition to the effect obtained by the first or second aspect of the invention, it is possible to easily attach the panel elements, hence improve the workability.

According to the fourth aspect of the invention, in addition to the effect obtained by any one of the first to third aspects of the invention, the panels can be simply laid out so as to provide an ordinary covering function, a heat radiating function and a contaminant collecting function.

According to the fifth aspect of the invention, since, in addition to the effect obtained by the fourth aspect of the invention, it is possible to use common component parts for the different panel elements and it is also possible to easily change each panel element depending on the functional configuration, the layout can be easily modified.

According to the sixth aspect of the invention, since, in addition to the effect obtained by the fourth aspect of the invention, it is possible to use common component parts for the different panel elements and it is also possible to easily change each panel element depending on the functional configuration, the layout can be easily modified.

According to the seventh aspect of the invention, in addition to the effect obtained by the fifth or sixth aspect of the invention, discharging of air from the inside of the apparatus and introduction of the outside air into the apparatus, can be easily done by simply replacing the panel elements.

According to the eighth aspect of the invention, in addition to the effect obtained by any one of the first to seventh aspects of the invention, it is possible to easily construct ventilation passages by simply arraying the panel elements without providing special ventilation holes in the panel elements.

According to the ninth aspect of the invention, in addition to the effect obtained by the eighth aspect of the invention, it is possible to makes the apparatus appearance fine by making it difficult to see the apparatus interior from the front and also to improve ventilation by making use of air flow caused by the temperature difference between the interior and exterior of the machine.

According to the tenth aspect of the present invention, it is possible to construct the exterior of an apparatus in a simple manner, and it is also possible to change the layout of the exterior simply in conformity with the processing configuration of the apparatus.

For example, each panel element is provided in the form of a panel that can be removably attached alone, or in a so-called "slide panel" form. Panel elements having different functions are appropriately used in combination in accordance with the functional configuration of the apparatus. This arrangement makes it possible to efficiently dissipate heat that has built up inside the apparatus to inhibit increase in the temperature inside the machine and also efficiently remove machine interior contamination due to contaminants.

According to the eleventh aspect of the invention, in addition to the effect obtained by the tenth aspect of the invention, it is possible to dissipate heat locally and efficiently from the areas where heat radiation is needed by simply replacing the panel elements. Accordingly, this configuration makes it possible to optimize the exterior layout without drastic change of the basic external structure.

According to the twelfth aspect of the invention, in addition to the effect obtained by the tenth or eleventh aspect of the invention, it is possible to locally collect floating contaminants from the areas where collection of contaminants is needed, by simply replacing the panel elements. Accordingly, this configuration makes it possible to easily optimize the exterior layout without drastic change of the basic external structure.

DESCRIPTION OF THE PREFERRED EMBODIMENTS

The First Embodiment

Now, one embodiment of the present invention will be described in detail with reference to the drawings.

Figure 1:
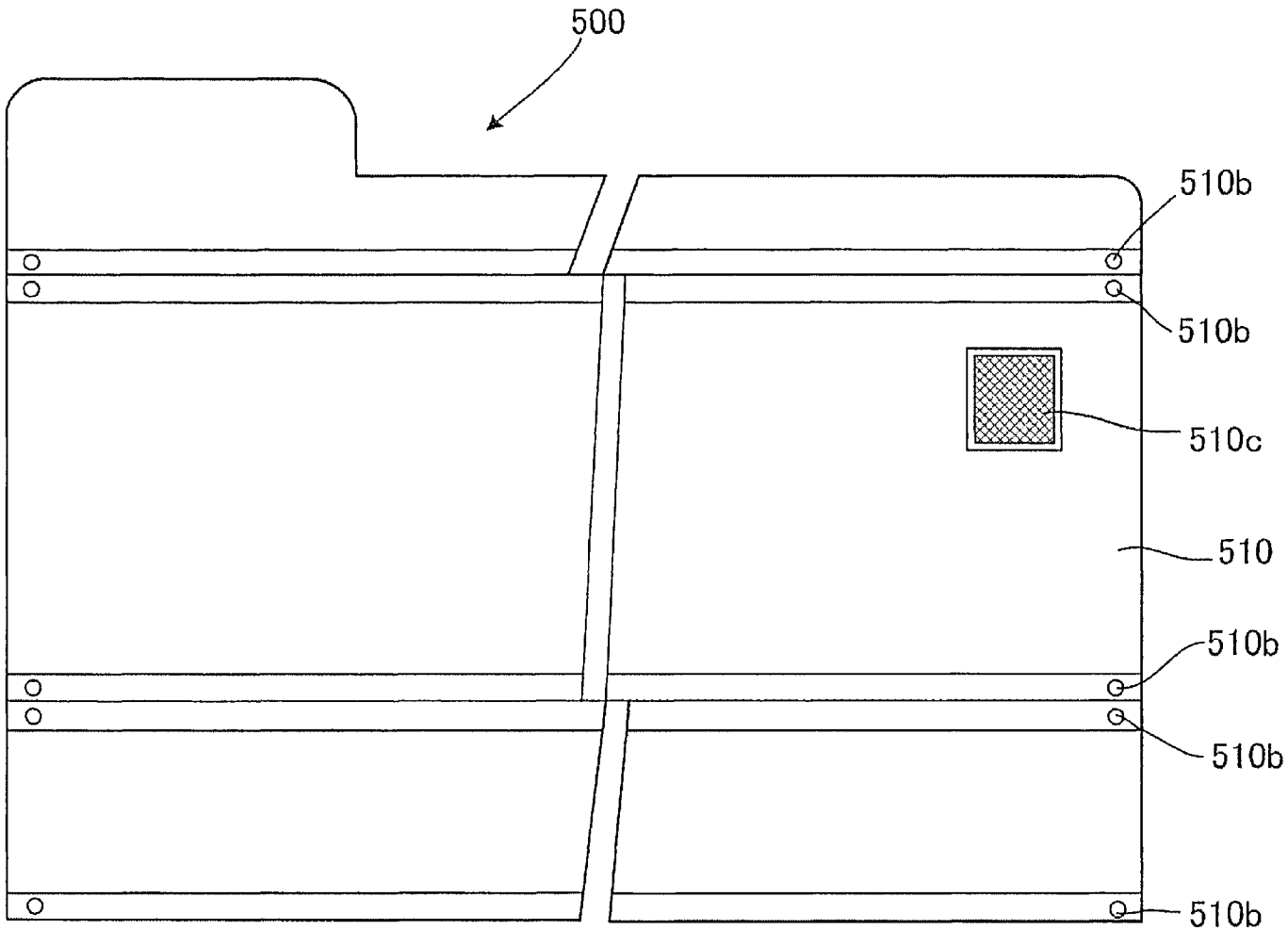
FIG. 1 PRIOR ART
FIG. 1 is a plan view showing one configurational example of a conventional exterior structure of an apparatus.
Figure 2:
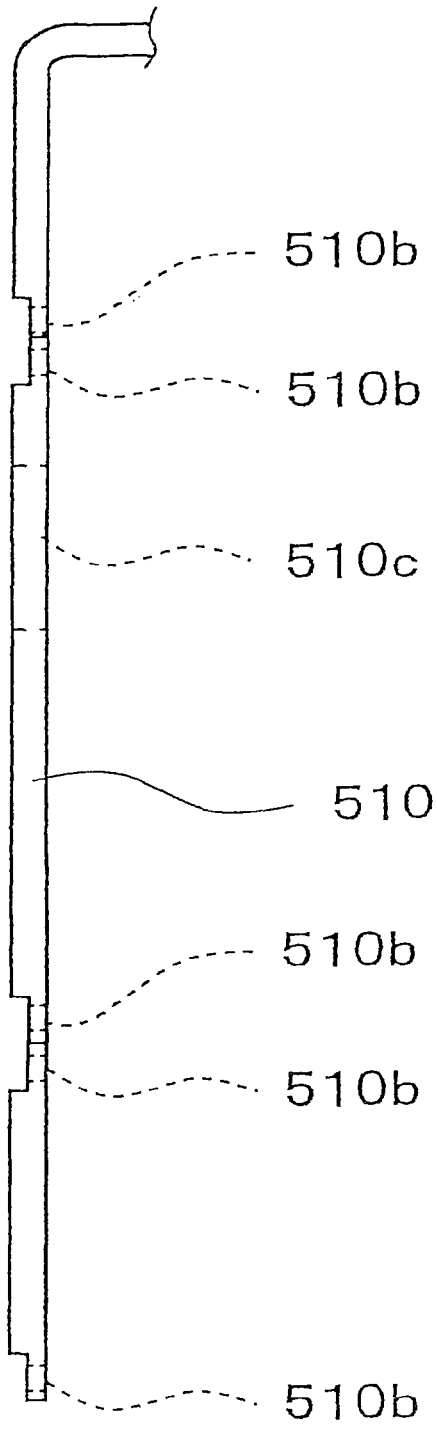
FIG.2 PRIOR ART
FIG. 2 is a side view showing the configuration of the same exterior structure.
Figure 3B:
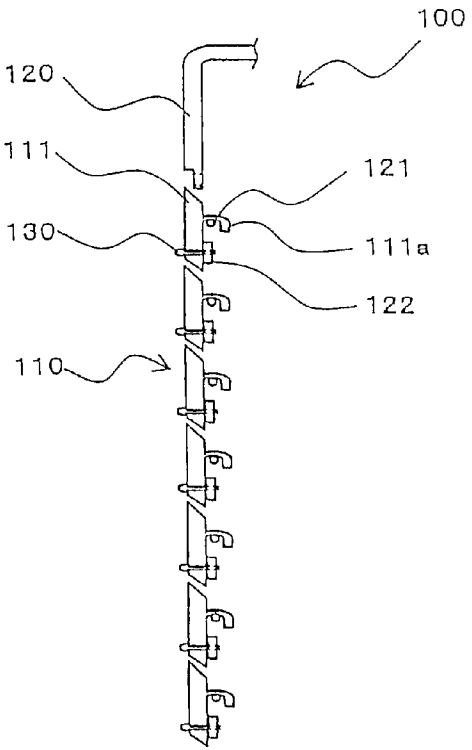
FIG. 3B is a schematic side view showing the configuration of the same exterior structure.
Figure 3A:
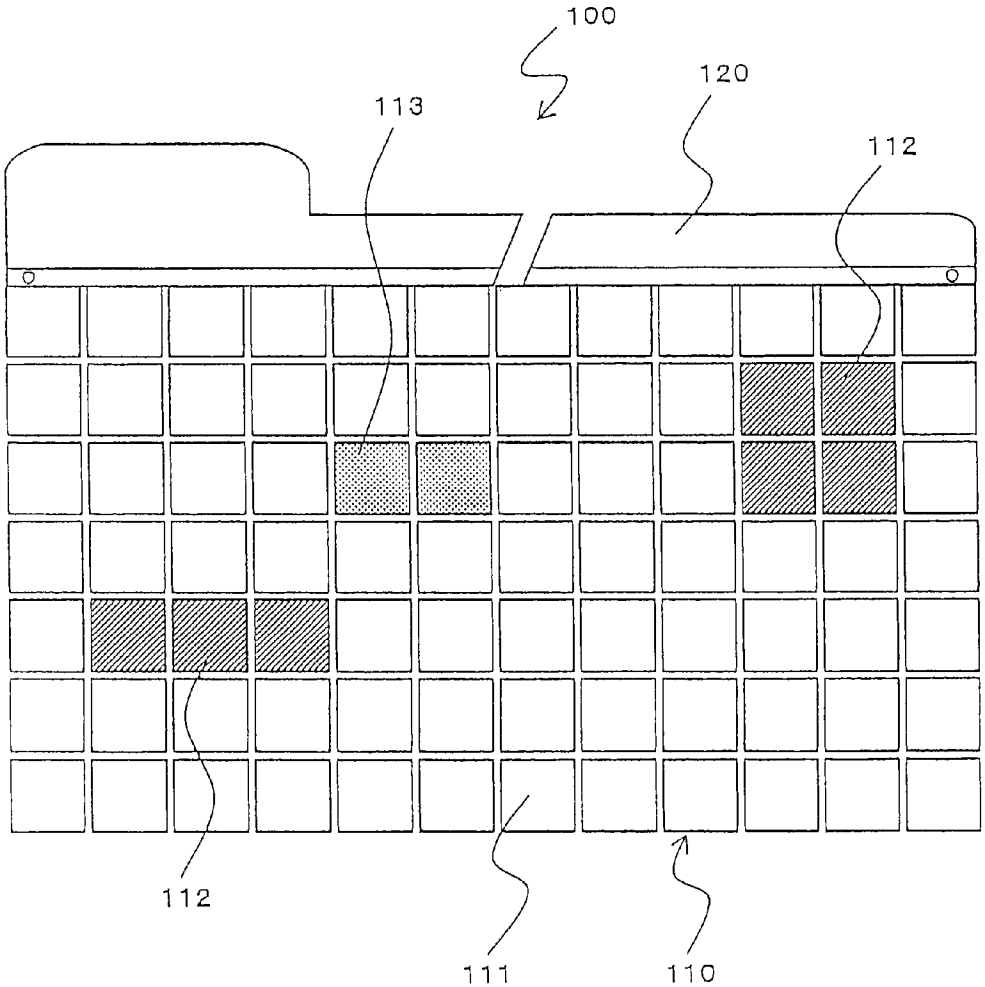
FIG. 3A is a schematic plan view showing a configuration of an exterior structure of an apparatus in accordance with the first embodiment of the present invention.
Figure 4A:
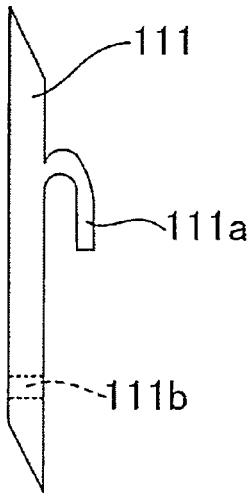
FIG. 4A a side view showing a configuration of a shielding panel, FIG. 4B a side view showing the configuration of a heat-radiating panel, FIG. 4C a side view showing the configuration of a machine-interior anti-scatter panel, FIG. 4D a side view showing a configuration of a shielding panel, FIG. 4E a side view showing the configuration of a heat-radiating panel and FIG. 4F a side view showing the configuration of a machine-interior anti-scatter panel.
Figure 4B:
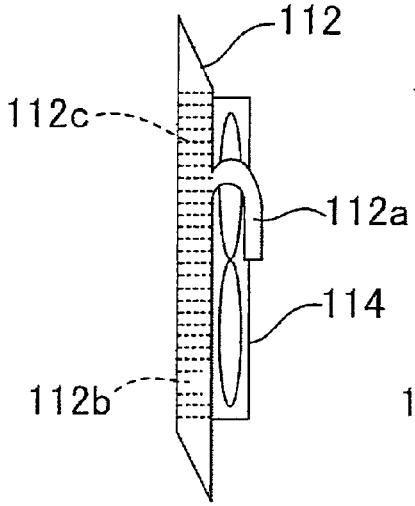
FIG. 4 is an illustrative view showing panel elements that constitute the same exterior structure.
Figure 4C:
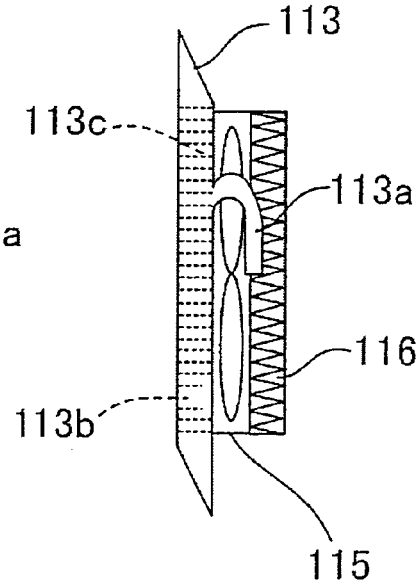
Figure 4D:
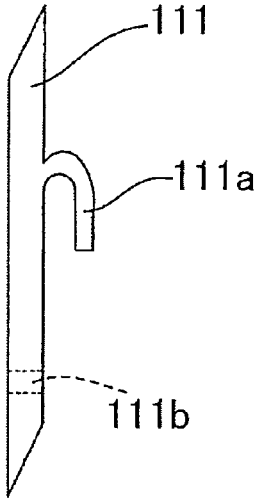
Figure 4E:
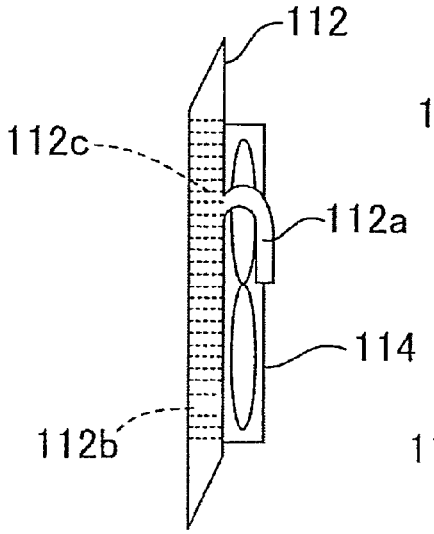
Figure 4F:
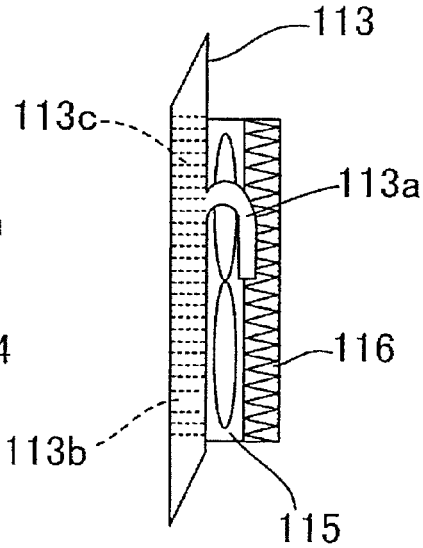
Figure 5:
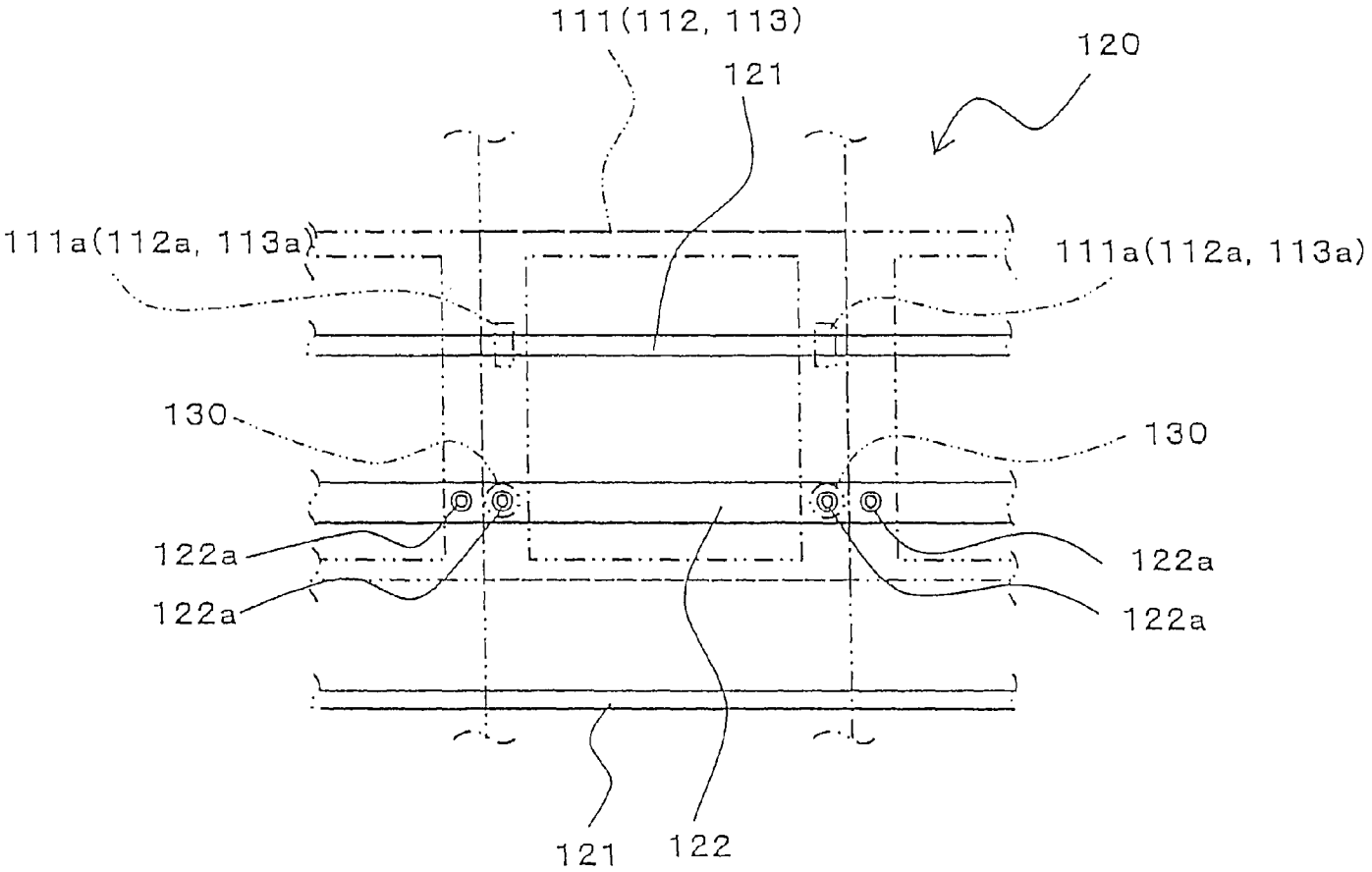
FIG. 5 is a partial illustrative view showing a configuration of a framework that constitutes the exterior structure.

FIGS. 3 to 5 show one mode of embodiment of the present invention. FIG. 3A is a schematic plan view showing a configuration of an exterior structure of an apparatus in accordance with the first embodiment of the present invention, and FIG. 3B is a schematic side view showing the configuration of the same exterior structure. FIG. 4 is an illustrative view showing configurations of panel elements that constitute the same exterior structure, FIGS. 4A and 4D are side views showing shielding panel configurations, FIGS. 4B and 4E are side views showing heat-radiating panel configurations, and FIGS. 4C and 4F are side views showing machine-interior anti-scatter panel configurations. FIG. 5 is a partial illustrative view showing a configuration of a framework that constitutes the same exterior structure.

An exterior structure 100 of a main body appliance of the present embodiment is comprised of, as shown in FIGS. 3 and 4, a multiple number of separated panel elements 110 and a framework 120. Exterior structure 100 is a structure that covers the outside of the main body appliance using multiple panel elements 110. The multiple panel elements 110 are essentially comprised of shielding panels 111, heat-radiating panels 112 and machine-interior anti-scatter panels 113. Each panel element 110 is attached to framework 120 formed on the main body appliance side. Arrangement of individual panel elements 110 to framework 120 can be done by using shielding panels 111, heat-radiating panels 112 and machine-interior anti-scatter panels 113 in combination appropriately depending on the functional configuration of the main body appliance.

Exterior structure 100 provides a covering function for covering the outside of the main body appliance and also provide a function of radiating heat from heat sources inside the main body appliance and a function of collecting floating contaminants inside the machine.

Shielding panels 111 cover the apparatus interior (main body appliance) from the outside. As shown in FIG. 3, each shielding panel 111 has a square configuration in its top view. As shown in FIG. 4A (FIG. 4D) and FIG. 5, formed on the interior side of shielding panel 111 are two inverted U-shaped hooks 111*a* that are curvedly projected downwards and arranged at both sides in the horizontal direction.

Hooks 111*a* are provided to position the panel to the apparatus and also prevent the panel from falling in the downward direction in the drawing. Formed under each hook 111*a* in shielding panel 111 is an attachment hole 111*b* for a screw 130 to fix the panel to framework 120 (FIG. 5).

Heat-radiating panel 112 provides a function of dissipating heat that is generated inside the apparatus (main body appliance). As shown in FIG. 3 heat-radiating panel 112 has the same square configuration as shielding panel 111, in its top view. Similarly to the shielding panel 111, two inverted U-shaped hooks 112*a* that are curvedly projected downwards and arranged at both sides in the horizontal direction are formed inwards from the interior side of shielding panel 112 as shown in FIG. 4B (FIG. 4E) and FIG. 5. An attachment hole 112*b* for screw 130 to fix the panel to framework 120 is formed under each hook 112*a* in heat-radiating panel 112.

Further, a flat square-shaped suctioning fan suctioning fan 114 is arranged on heat-radiating panel 112 at its rear side facing the machine interior. This suctioning fan 114 is sized and positioned so that its projection onto heat-radiating panel 112 will not jut out of the circumference of heat-radiating panel 112.

Further, a multiple number of ventilation holes 112*c* for establishing communication between the interior and exterior of the panel are formed in the area where suctioning fan 114 opposes heat-radiating panel 112.

Machine-interior anti-scatter panel 113 provides a function of collecting scattered toner and floating dust inside the apparatus (main body appliance). As shown in FIG. 3, machine-interior anti-scatter panel 113 has the same square configuration as shielding panel 111 and heat-radiating panel 112, in its top view. Similarly to the shielding panel 111 and heat-radiating panel 112, two inverted U-shaped hooks 113*a* that are curvedly projected downwards and arranged at both sides in the horizontal direction are formed on the interior side of machine-interior anti-scatter panel 113 as shown in FIG. 4C (FIG. 4F) and FIG. 5. An attachment hole 113*b* for screw 130 to fix the panel to framework 120 is formed under each hook 113*a* in machine-interior anti-scatter panel 113.

Further, a flat square-shaped exhaust fan 115 is arranged on machine-interior anti-scatter panel 113 on its rear side facing the machine interior. This exhaust fan 115 is sized and positioned so that its projection onto machine-interior anti-scatter panel 113 will not jut out of the circumference of machine-interior anti-scatter panel 113. A filter 116 is arranged on the upstream side of this exhaust fan 115 with respect to the direction of exhaust (the direction from the interior to exterior of the machine) and laid over the fan.

Further, a multiple number of ventilation holes 113*c* for establishing communication between the interior and exterior of the panel are formed in the area where exhaust fan 115 opposes machine-interior anti-scatter panel 113.

Each panel element 110 (111, 112, 113) is formed in an approximately parallelogrammatic shape in its side sectional view. That is, the upper and lower edges of each panel element 110 are formed point symmetrically in a wedge-like shape, when sectionally viewed from its side. This wedge-like portion forms an inclined surface that inclines with respect to the panel surface. In each panel element 110 shown in FIGS. 4A to 4C, the inclined surface along the upper edge faces the inside of the apparatus main body and the inclined surface along the lower edge faces the outside of the apparatus main body. On the other hand, in each panel element 110 shown in FIGS. 4D to 4F, the inclined surface along the upper edge faces the outside of the apparatus main body and the inclined surface along the lower edge faces the inside of the apparatus main body. Though the inclined surfaces along the upper and lower edges in each panel element in FIGS. 4A to 4F are formed so as to have equal angles of inclination, they can have different angles of inclination.

On the apparatus main body side, framework 120 is laid out along the areas to be covered by panel elements 110. Any of shielding panel 111, heat-radiating panel 112 and machine-interior anti-scatter panel 113 can be attached as appropriate to this framework 120.

As shown in FIG. 5, in framework 120 lateral bars 121 on which the hooks (111*a*, 112*a*, 113*a*) of each panel (111, 112, 113) are hanged and crosspieces 122 are alternately arranged horizontally and approximately parallel to each other. In each crosspiece 122 a plurality of screw holes 122*a* for fixing panel elements 110 with screws are formed at positions where panel elements 110 are to be attached.

According to the present embodiment thus constructed, when the apparatus main body is covered, if there are heat sources and contamination sources such as toner, dust etc., inside the apparatus, it is possible to cool the apparatus interior and collect contaminants locally and efficiently by laying out shielding panels 111, heat-radiating panels 112 and machine-interior anti-scatter panels 113 in a suitable manner as shown in FIG. 3.

Further, according to the present embodiment, separate provision of shielding panels 111, heat-radiating panels 112 and machine-interior anti-scatter panels 113 with identical configurations facilitates change of the panel layout.

Moreover, according to the present embodiment, since shielding panels 111, heat-radiating panels 112 and machine-interior anti-scatter panels 113 can be positioned and fixed to framework 120 that is provided on the apparatus side, this configuration facilitates assembly and replacement and contributes to improvement in workability.

Next, one configurational example of an exterior structure according to the present embodiment will be described with reference to the drawings.

Figure 6:
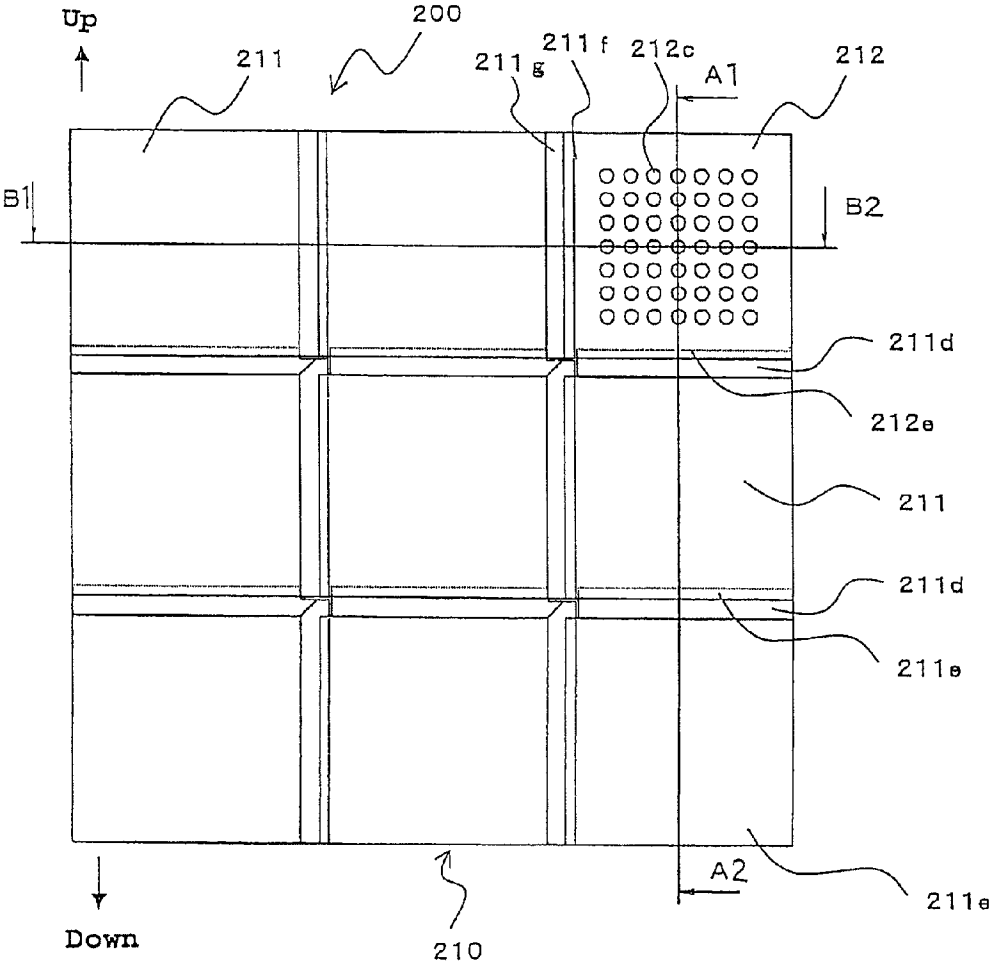
FIG. 6 is a plan view showing a configurational example of an exterior structure in accordance with the first embodiment.
Figure 7:
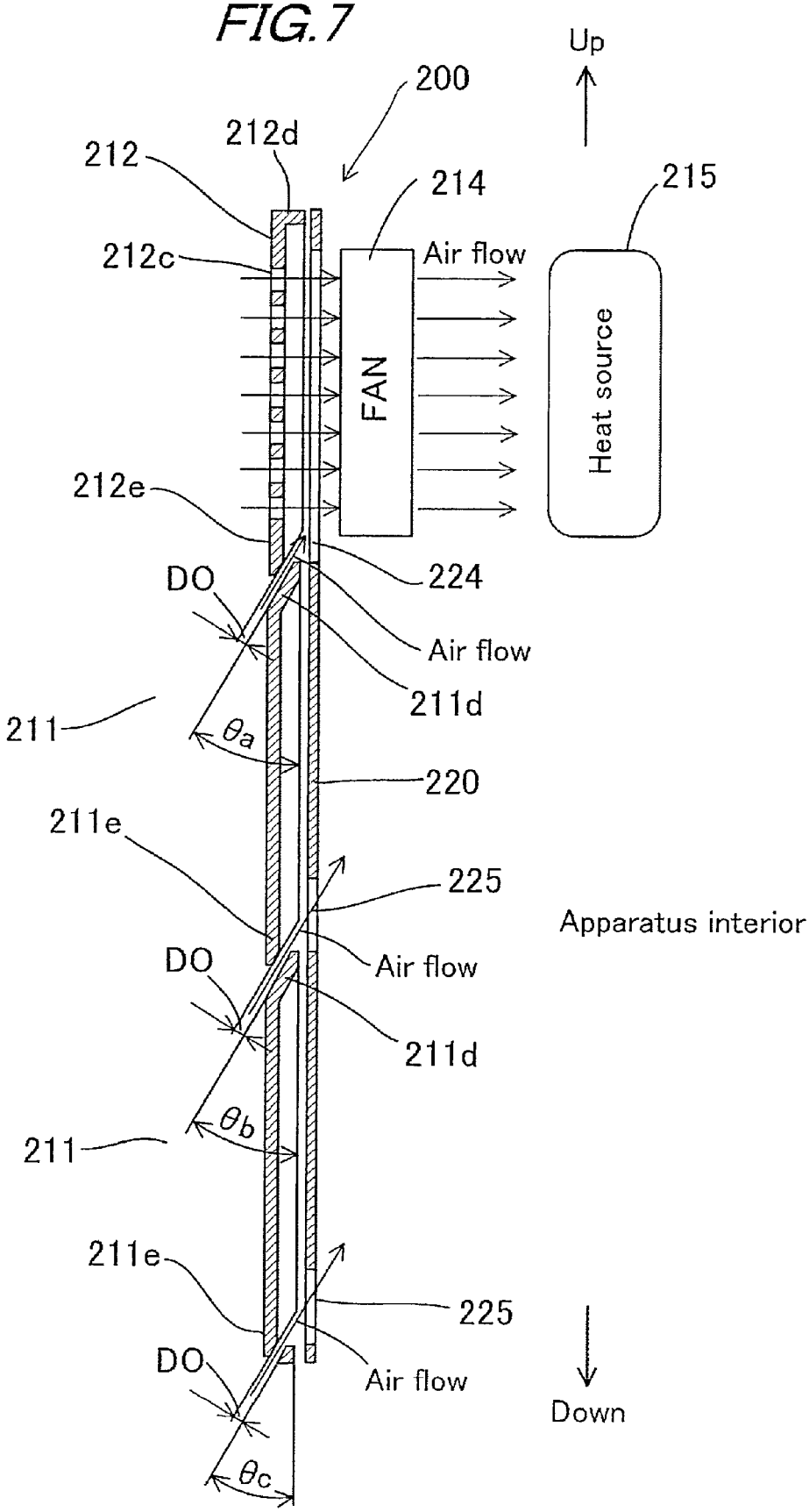
FIG. 7 is a sectional view of the same exterior structure, cut along plane A1-A2 in FIG. 6.
Figure 8:
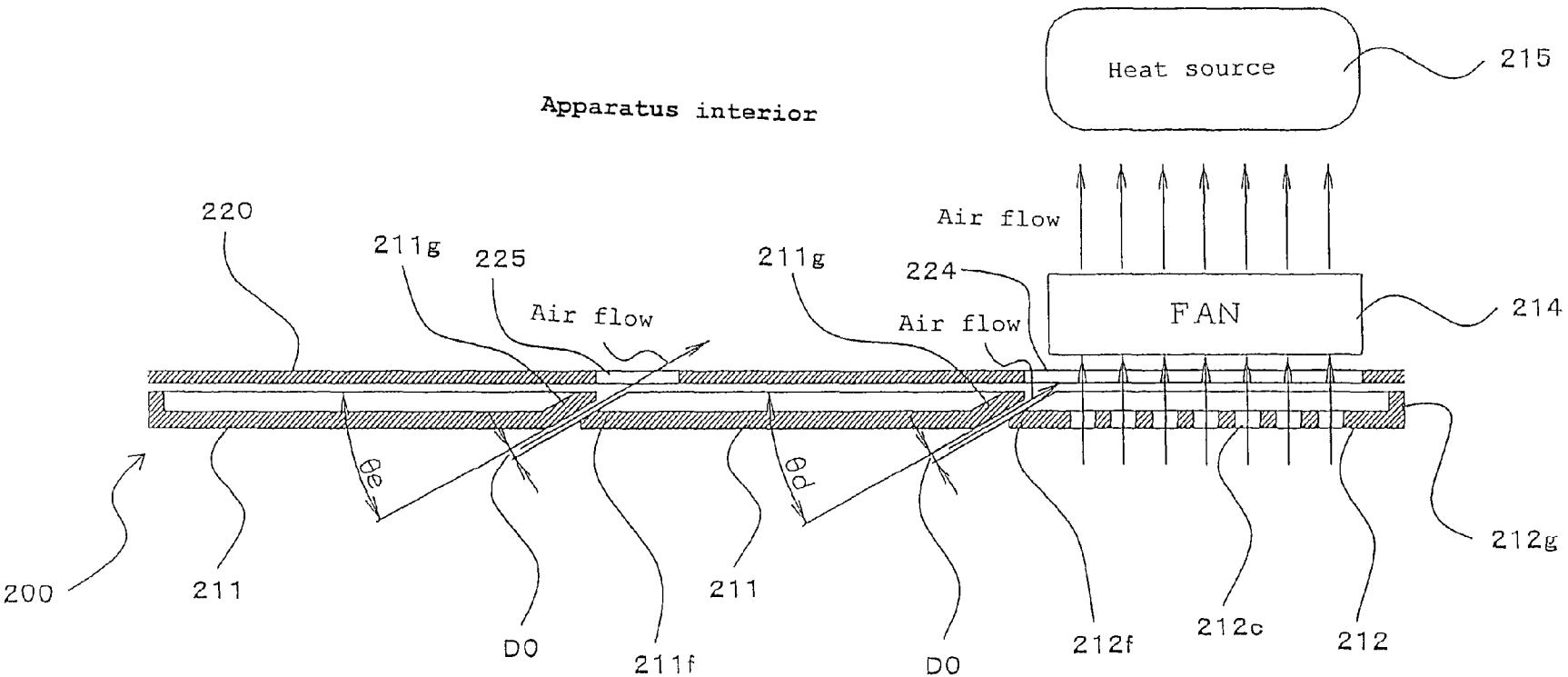
FIG. 8 is a sectional view of the same exterior structure, cut along plane B1-B2 in FIG. 6.

FIG. 6 is a panel view showing a configurational example of an exterior structure in accordance according to the present embodiment; FIG. 7 is a sectional view of the same exterior structure, cut along plane A1-A2 in FIG. 6; and FIG. 8 is a sectional view of the same exterior structure, cut along plane B1-B2 in FIG. 6.

An external structure 200 in the present embodiment is constructed such that a multiple number of shielding panels 211, heat-radiating panels 212 are arrayed as panel elements 210 over a framework 220 on the apparatus side, as shown in FIG. 6.

Here, the shielding panel 211 and heat-radiating panel 212 in the present embodiment has the same shape and configuration as those of shielding panel 111 and heat-radiating panel 112 in the embodiment described above. That is, these panels 111 and 112 have hooks 111*a* and 112*a* and attachment holes 111*b* and 112*b*, respectively. Accordingly, only the characteristic configurations of shielding panel 211 and heat-radiating panel 212 will be described omitting the illustration and description of their basic configurations.

As shown in FIG. 7, shielding panel 211 has inclined surfaces formed at its upper and lower edges 211*d* and 211*d* so that the panel has an approximately parallelogrammatic side section. These inclined surfaces are so formed that the inclined surface along upper edge 211*d* faces the outside of the apparatus and the inclined surface along the lower edge 211*e* faces the inside of the apparatus. The inclined surface along upper edge 211*d* is inclined downward from the rear side (the inside of the apparatus) to the front side (the outside of the apparatus), forming an inclined angle θa to θc relative to the panel surface. Shielding panels 211 are formed so that the inclined portion along upper end edge 211*d* of one panel overlaps the inclined portion along lower end edge 211*e* of another adjacent panel (θa=θb=θc). That is, the upper edge part 211*d* and lower edge part 211*e* of shielding panel 211 have point symmetrical surfaces. Though the upper edge part 211*d* and lower edge part 211*e* are formed so as not to be point symmetrical with each other in the sectional side view in FIG. 7, they may be formed to be point symmetrical (see FIG. 4).

Also, as shown in FIG. 8, shielding panel 211 has inclined surfaces formed at both the side edges 211*f* and 211*g* so that the panel has an approximately parallelogrammatic horizontal section. These inclined surfaces are so formed that the inclined surface along side edge 211*f* faces the inside of the apparatus and the inclined surface along the other side edge 211*g* faces the outside of the apparatus. The inclined surface along side edge 211*g* is inclined forming an inclined angle θd to θe relative to the panel surface. Shielding panels 211 are formed so that the inclined portion along the side edge 211*f* of one panel overlaps the inclined portion along the side edge 211*g* of another adjacent panel (θd=θe). That is, the side edge parts 211*f* and 211*g* of shielding panel 211 have point symmetrical surfaces. Though the side edge parts 211*f* and 211*g* are formed so as not to be point symmetrical with each other in the horizontal sectional view in FIG. 8, they may be formed to be point symmetrical (see FIG. 4).

These adjoining shielding panels 211 are overlapped one another so that a predetermined gap D0 is formed between the upper edge part 211*d* of one panel and lower edge part 211*e* of the adjacent one and between side edge part 211*f* of one panel and side edge part 211*g* of the adjacent one. That is, these gaps D0 created by adjacent shielding panels 211 assure ventilation between the inside and outside of the apparatus.

Here in the present embodiment, the inclined angles θa to θe are set to be identical, but it is possible to differentiate these inclined angles different to thereby make the size of gaps D0 different depending on the locations of the panels. It is also possible to form the ventilating passage defined by gap D so as to be tapering, by differentiating the inclined angles of the sides of each panel.

Further, shielding panels 211 arranged along the border of exterior structure 200 are formed so that their end portions corresponding to the border have a rectangular section. This makes the appearance of exterior structure 200 fine.

Since heat-radiating panel 212 has a similar external configuration to that of the above-described shielding panel 211, only the characteristic configuration will be described omitting its external configuration.

As shown in FIGS. 6 to 8, heat-radiating panel 212 is formed so that its lower end part 212*e* and one side part 212*f* next to shielding panels 211 are formed in a wedge-like shape, inclining with respect to the panel surface from the interior side to the exterior side while the upper end part 212*d* and the other side part 212*g* located along the border of external structure 200 are formed having a rectangular section, instead of a wedge-like section. This makes the appearance of the exterior structure 200 fine.

Arranged on heat-radiating panel 212 at its rear side facing the machine interior is a flat square-shaped suctioning fan 214, as shown in FIGS. 7 and 8. This suctioning fan 214 is sized and positioned so that its projection onto heat-radiating panel 212 will not jut out of the circumference of heat-radiating panel 212.

Further, a multiple number of ventilation holes 212*c* for establishing communication between the interior and exterior of the panel are formed in the area where suctioning fan 214 opposes heat-radiating panel 212. Heat-radiating panel 212 is arranged at a position opposing a heat source 215 laid out inside the apparatus so that suctioning fan 214 can take in the external air from the outside of the apparatus through ventilation holes 212*c* and send the air to heat source 215 to thereby cool the heat source 215 by air.

A reference numeral 224 in the drawing designates an opening that is formed opposing heat-radiating panel 212 and another reference numeral 225 designates an opening that is formed opposing shielding panel 211.

Here, in attachment of suctioning fan 214 to heat-radiating panel 212 a filter (not shown) may be interposed therebetween. With this arrangement it is possible to prevent dust and particles floating externally from being taken into the apparatus.

Framework 220 is arranged on the apparatus side along the areas to be covered, and basically has the same configuration as the above embodiment. This framework 220 is constructed so that shielding panels 211, heat-radiating panels 212 and machine-interior anti-scatter panels 213 can be attached thereto as appropriate.

According to the present embodiment constructed as above, in addition to the function and effect given by the aforementioned embodiment, shielding panel 211 and heat-radiating panel 212 are formed so that their edges adjoining to neighboring panels, specifically, upper and lower edges 211*d* and 211*e* and both side edges 211*f* and 211*g* of shielding panel 211 and lower edge 212*e* and one side edge 212*f* of heat-radiating panel 212 are formed in a wedge-like configuration so as to incline downward or sideward from the interior side to the external side with respect to the panel surface, it is possible to create good ventilation between the interior and exterior of the apparatus through the gaps D0 defined by the inclined surfaces between adjacent panels and make good appearance of the apparatus, screening the apparatus interior from the front.

Here, framework 220 of this configurational example is formed of lateral bars and crosspieces, similarly to the framework 120 of the above-described embodiment, but the framework of the present invention should not be limited to this. A variational example of this example will be shown hereinbelow.

Figure 9:
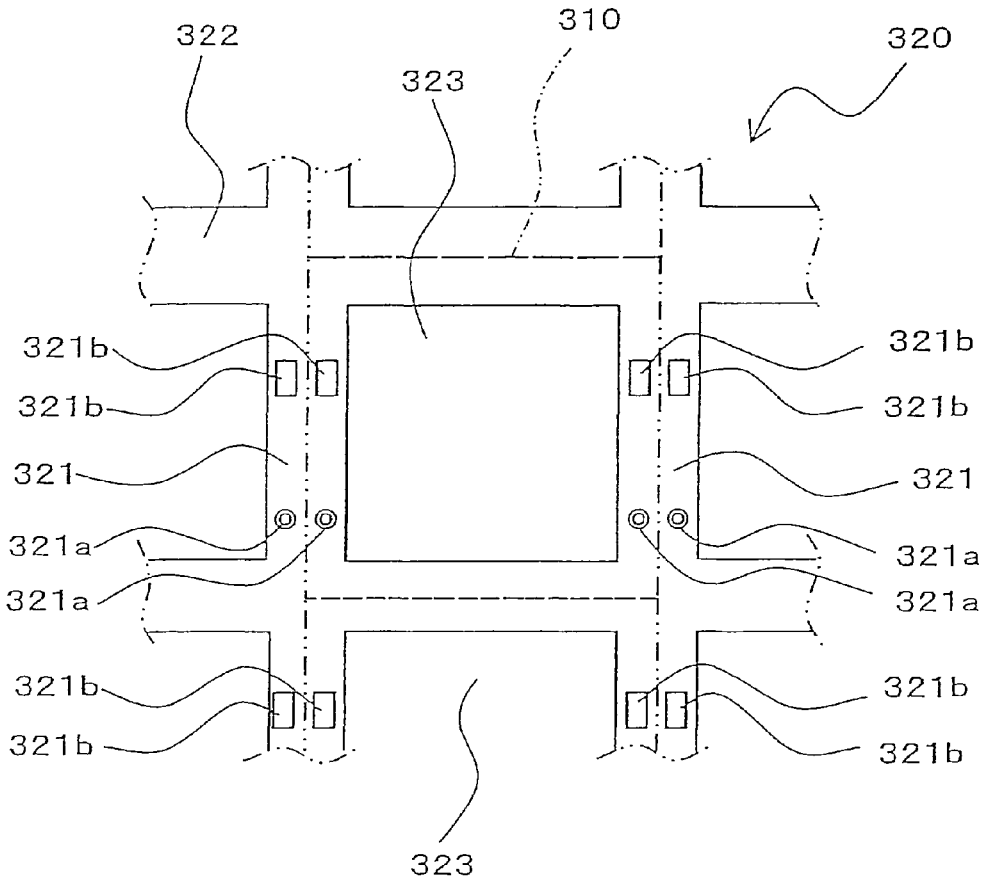
FIG. 9 is a partial illustrative view showing a variational example of the above framework configuration.

FIG. 9 is a partial illustrative view showing a variational example of the above framework configuration of the configurational example.

In this variational example, a framework 320 is formed in a lattice-like configuration of vertical frame pieces 321 and horizontal frame pieces 322, as shown in FIG. 9. The vertical frame pieces 321 and horizontal frame pieces 322 are arranged with appropriate pitches depending on the shape of panel elements 310 to be arrayed so that the panel elements can attached thereto.

Vertical frame piece 321 is formed with attachment holes 321*b* on which the hooks (not shown) similarly formed on the panel element of the former embodiment and the configurational example can be hanged and screw holes 321*a* for screws (not shown) for fixing panel elements 310.

Screw holes 321*a* and attachment holes 321*b* are formed as appropriate in accordance with the configuration and fixed positions of panel elements 310, and these holes may be formed in horizontal frame pieces 322, not limited to vertical frame pieces 321 in some cases depending on the configuration of framework 320.

A reference numeral 323 in the drawing designates an opening.

Further, the configuration of the panel element of the present invention should not be limited to that described in the former embodiment and the configurational example. A variational example from the above configurational example will be described next.

Figure 10:
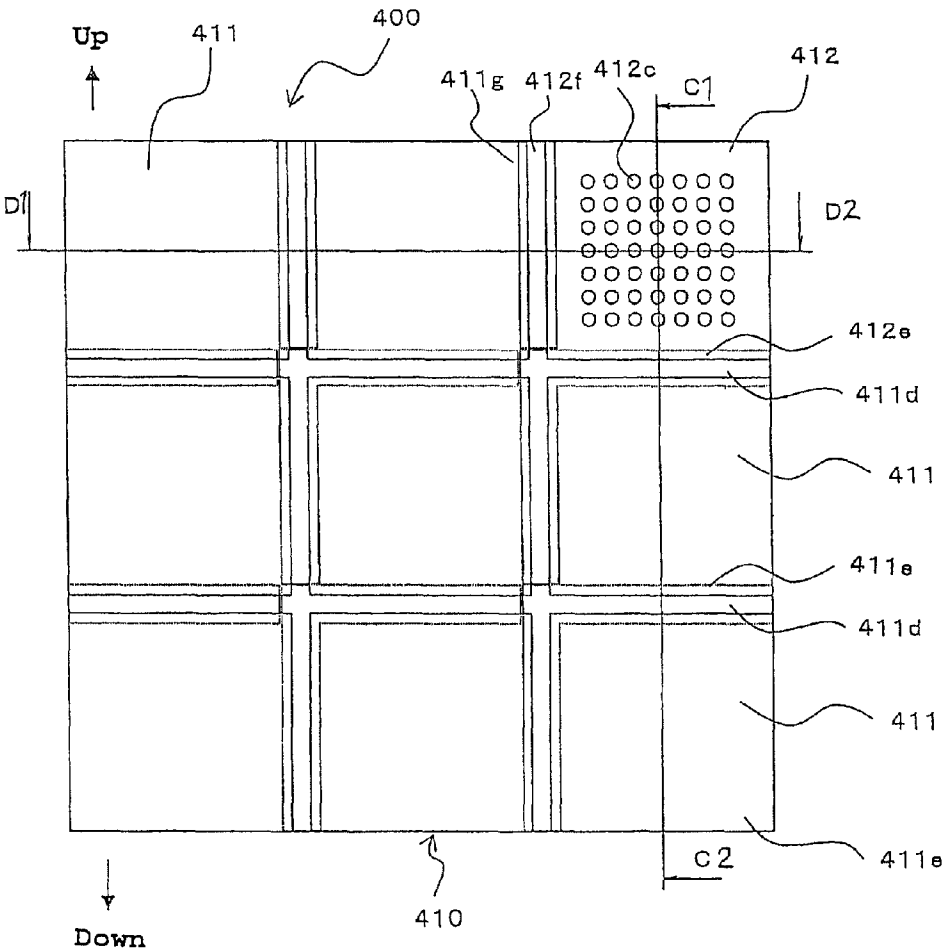
FIG. 10 is a plan view showing a variational example of the above exterior structure configuration.
Figure 11:
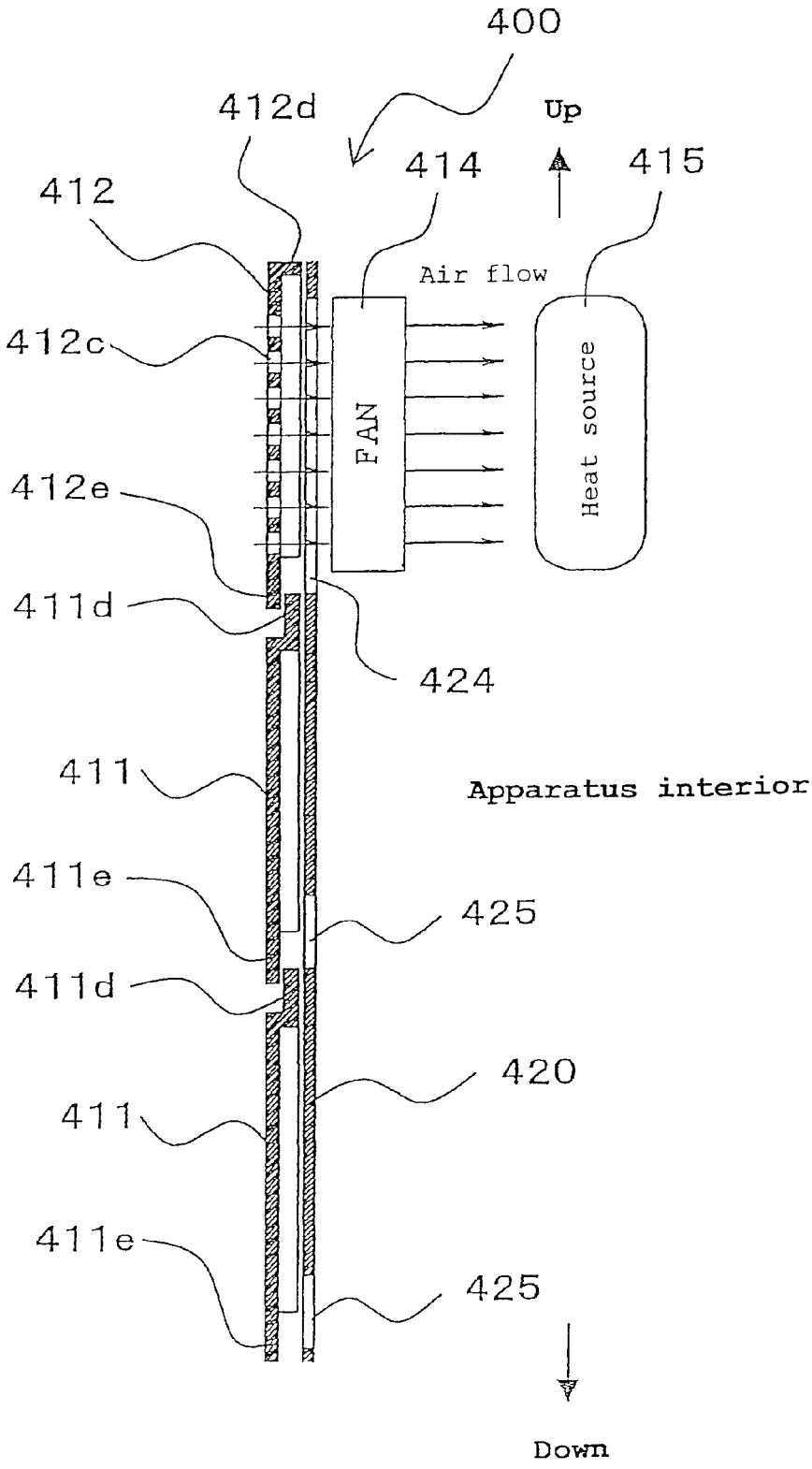
FIG. 11 is a sectional view of the same exterior structure, cut along plane C1-C2 in FIG. 10.

FIG. 10 is a plan view of a variational example of the exterior structure according to the present invention; FIG. 11 is a sectional view of the same exterior structure, cut along plane C1-C2 in FIG. 10; and FIG. 12 is a sectional view of the same exterior structure, cut along plane D1-D2 in FIG. 10.

Figure 12:
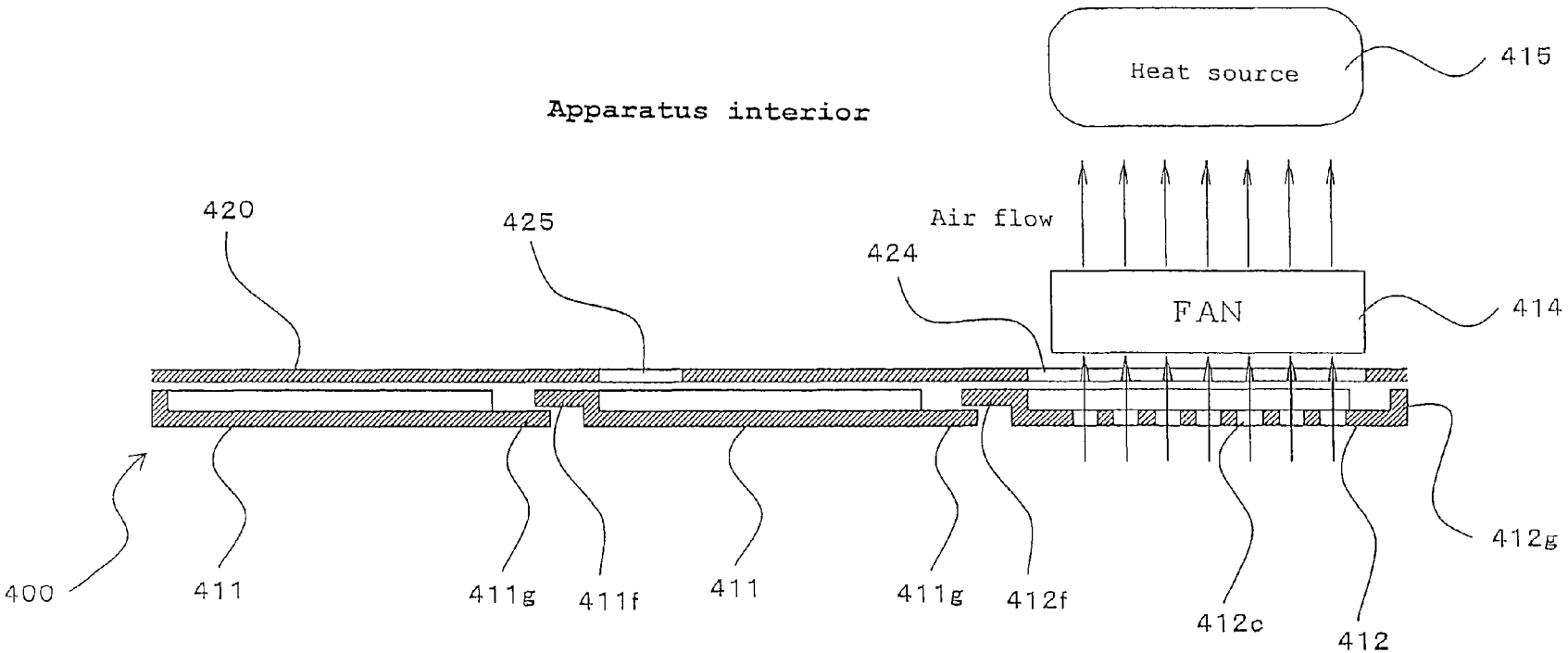
FIG. 12 is a sectional view of the same exterior structure, cut along plane D1-D2 in FIG. 10.

As shown in FIGS. 10 to 12, this variational example is constructed such that a multiple number of shielding panels 411 and heat-radiating panels 412 as panel elements 410 constituting an exterior structure 400 are arrayed on a framework 420 (FIG. 11) provided on the apparatus side. In this variational example, the edges of shielding panel 411 and heat-radiating panel 412 overlapping each other are formed in a stepped configuration having an approximately L-shaped section.

Specifically, shielding panel 411 is constructed such that its upper edge 411*d* is formed in a stepped configuration having an approximately L-shaped section as shown in FIG. 11 while lower edge 411*e* is formed so as to allow part of the upper edge 411*d* to fit into the lower side thereof. That is, adjacent shielding panels 411 are laid out so that their exterior surfaces are flush with each other while the upper edge 411*d* of one panel and lower edge 411*e* of the other panel overlap one over the other.

Further, shielding panel 411 is constructed such that its one side edge 411*f* is formed in a stepped configuration having an approximately L-shaped section as shown in FIG. 12 while the other side edge 411*g* is formed so as to allow part of the one side edge 411*f* to fit into the lower side thereof. That is, adjacent shielding panels 411 are laid out so that their exterior surfaces are flush with each other while the one side edge 411*f* of one panel and the other side edge 411*g* of the other panel overlap one over the other.

As shown in FIGS. 10 to 12, heat-radiating panel 412 is constructed such that its one side edge 412*f* is formed in a stepped configuration having an approximately L-shaped section while part of one side edge 412*f* fits into the lower side of the other edge 411*g* of adjacent shielding panel 411. Further, lower end 412*e* is formed so as to allow part of upper edge 411*d* of shielding panel 411 to fit thereinto.

Further, the upper edge 412*d* (FIG. 11) and the other side edge 412*g* (FIG. 12) located along the border of exterior structure 400 are formed to be flat. This contributes to improvement of the appearance of exterior structure 400.

Arranged on heat-radiating panel 412 at its rear side facing the machine interior is a flat square-shaped suctioning fan 414 as shown in FIGS. 11 and 12, in the same manner as in the above embodiment so that its projection fall within the range of the panel.

Further, a multiple number of ventilation holes 412*c* for establishing communication between the interior and exterior of the panel are formed in the area where suctioning fan 414 opposes heat-radiating panel 412. Heat-radiating panel 412 is arranged at a position opposing a heat source 415 laid out inside the apparatus so that suctioning fan 414 can take in the external air from the outside of the apparatus through ventilation holes 412*c* and send the air to heat source 415 to thereby cool the heat source 415 by air.

A reference numeral 424 in the drawing designates an opening that is formed opposing heat-radiating panel 412 and another reference numeral 425 designates an opening that is formed opposing shielding panel 411.

This configuration makes it possible to simplify the basic configuration of panel elements 410, hence reduce the manufacturing cost and makes assembly and replacement work easy to thereby improve workability.

The Second Embodiment

Next, an image forming apparatus 1A including a transfer device 10 (FIG. 13) according to the present invention will be described with reference to the drawings.

Figure 13:
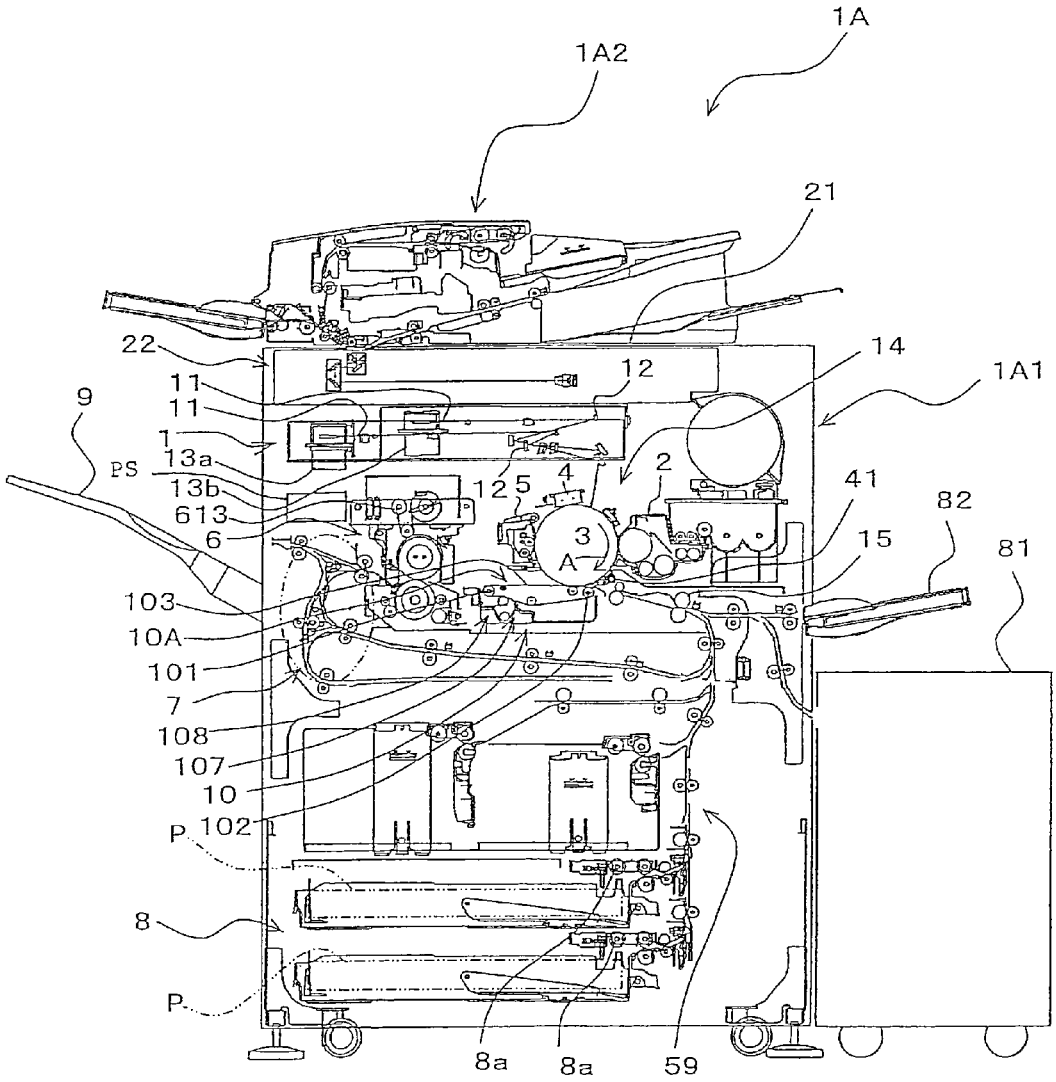
FIG. 13 is an illustrative view showing an overall configuration of an image forming apparatus that adopts an exterior structure in accordance with the second embodiment of the present invention.
Figure 14:
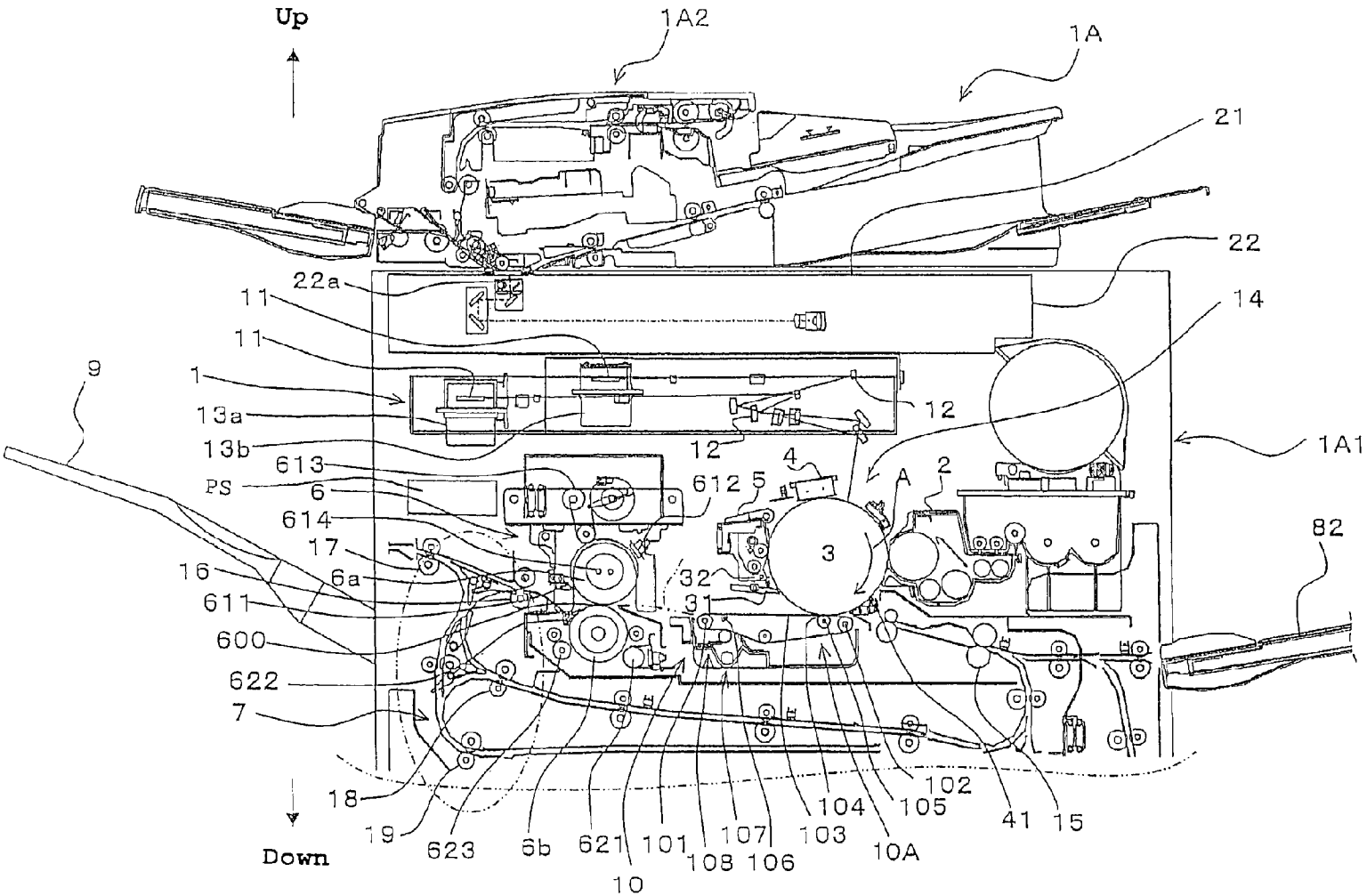
FIG. 14 is a partial detailed view showing the apparatus main body configuration of the same image forming apparatus.

FIG. 13 is an illustrative view showing the overall configuration of an image forming apparatus using an exterior structure according to the second embodiment of the present invention and FIG. 14 is a partial detailed view showing the configuration of the main body of the image forming apparatus.

Image forming apparatus 1A according to the present embodiment is an image forming apparatus that includes an image forming portion 14, transfer device 10, fixing unit (fixing device) 6 and a conveyor system, and produces image output in response to a print request. As the exterior structure that covers the outside of the image forming apparatus main body, the exterior structure of an apparatus according to the present invention is adopted.

Image forming portion 14 has a photoreceptor drum (electrostatic latent image support) 3 on which a developer image (toner image) is formed with a developer (toner).

Transfer device 10 has a transfer unit 10A. Transfer unit 10A includes a transfer belt (conveyor belt) 103 for conveying paper P and transfers a toner image that was developed on photoreceptor drum 3 to paper P that is conveyed by the transfer belt 103.

Fixing unit 6 fixes the toner image that was transferred on paper P to paper P.

The conveyor system conveys and discharges the paper P that has been print processed.

To begin with, the overall configuration of image forming apparatus 1A according to the present embodiment will be described with reference to the drawings.

As shown in FIGS. 13 and 14, image forming apparatus 1A is essentially composed of a main body 1A1 including a light exposure unit 1, a developing unit 2, a photoreceptor drum 3, a charger 4, a charge erasing device 41, a cleaner unit 5, a fixing unit 6, a paper feed path 7, a paper feed tray 8, a paper output tray 9, a transfer device 10 and the like, and an automatic document processor 1A2.

Formed on the top surface of main body 1A1 is an original placement table 21 made of transparent glass on which a document is placed. Automatic document processor 1A2 is arranged on the top of this original placement table 21 so that it can pivotally open upwards. On the other hand, a scanner portion 22 as a document reader for reading image information of originals is laid out under this original placement table 21.

Arranged below scanner portion 22 are light exposure unit 1, developing unit 2, photoreceptor drum 3, charger 4, a charge erasing device 41, cleaner unit 5, fixing unit 6, paper feed path 7, paper output tray 9 and transfer device 10. Further, paper feed tray 8 for accommodating paper P is arranged under these components.

Light exposure unit 1 emits a laser beam in accordance with the image data (print image information) output from an unillustrated image processor to irradiate the photoreceptor drum 3 surface that has been uniformly charged by charger 4. In this way, light exposure unit 1 writes and forms an electrostatic latent image corresponding to the image data on the photoreceptor drum 3 surface.

Light exposure unit 1 is arranged directly under scanner portion 22 and above photoreceptor drum 3. Light exposure unit 1 includes laser scanning units (LSUs) 13*a* and 13*b* each having a laser emitter 11 and a reflection mirror 12. In the present embodiment, in order to achieve high-speed printing operation, a method for alleviating a rush of irradiation timings by using a multiple number of laser beams, namely a two-beam method, is adopted.

Here, in the present embodiment laser scanning units (LSUs) 13*a* and 13*b* are used for light exposure unit 1, but an array of light emitting elements, e.g., an EL or LED writing head may be used.

Photoreceptor drum 3 has a cylindrical shape and is arranged under light exposure unit 1 as shown in FIG. 14. Photoreceptor drum 3 is controlled so as to rotate in a predetermined direction (in the direction of arrow A in the drawing) by an unillustrated drive means and control means. Arranged starting from the position at which image transfer ends downstream in the rotational direction of the photoreceptor drum along the peripheral surface of this photoreceptor drum 3 are a paper separation claw 31, cleaner unit 5, charger 4 as an electric field generator, developing unit 2 and a charge erasing device 41 in the order mentioned.

Paper separation claw 31 is disposed so as to be moved into and out of contact with the outer peripheral surface of photoreceptor drum 3 by means of a solenoid 32. This paper separation claw 31, when it is put in abutment with the outer peripheral surface of photoreceptor drum 3, functions to peel off the paper P that has adhered to the photoreceptor drum 3 surface.

As a drive means for paper separation claw 31, a drive motor or the like may be used instead of solenoid 32, or any other drive means may also be selected.

Developing unit 2 visualizes the electrostatic latent image formed on photoreceptor drum 3 with black toner. Developing unit 2 is arranged at approximately the same level at the side (on the right side in the drawing) of photoreceptor drum 3 downstream of charger 4 with respect to the rotational direction of the photoreceptor drum (in the direction of arrow A in the drawing). A registration roller 15 is disposed under this developing unit 2.

Registration roller 15 is operated and controlled by an unillustrated driver and controller so as to convey the paper P delivered from paper feed tray 8 (FIG. 13) into and between photoreceptor drum 3 and transfer belt 103 whilst making the leading end of the paper P register with the toner image on the photoreceptor drum 3.

Charger 4 is a charging means for uniformly charging the photoreceptor drum 3 surface at a predetermined potential. Charger 4 is arranged over photoreceptor drum 3 and close to the outer peripheral surface thereof.

Here, a discharge type charger 4 is used in the present embodiment, but a contact roller type or a brush type may be used.

Charge erasing device 41 is a pre-transfer erasing portion for lowering the surface potential of the photoreceptor drum 3 in order to facilitate the toner image formed on the photoreceptor drum 3 surface to transfer to paper P. Charge erasing device 41 is laid out on the downstream side of developing unit 2 with respect to the photoreceptor drum's direction of rotation and under photoreceptor drum 3 and close to the outer peripheral surface of the same.

Though in the present embodiment, charge erasing device 41 is configured using a charge erasing electrode, a charge erasing lamp or any other method for erasing charge can be used instead of the charge erasing electrode.

Cleaner unit 5 removes and collects the toner left on the surface of photoreceptor drum 3 after development and image transfer. Cleaner unit 5 is disposed at approximately the same level at the side of photoreceptor drum 3 (on the left side in the drawing), on the approximately opposite side across photoreceptor drum 3 from developing unit 2.

As described above, the visualized electrostatic image on photoreceptor drum 3 is transferred to the paper P to which transfer device 10 applies an electric field having an opposite polarity to that of the electrostatic image.

For example, when the electrostatic image bears negative (−) charge, the applied polarity of transfer device 10 should be positive (+).

Transfer device 10 is provided in the form of a transfer belt unit. As shown in FIG. 14 transfer device 10 includes a transfer unit 10A in which transfer belt 103 having a predetermined resistivity (ranging from $1\times10^{9}$ to $1\times10^{13}\Omega\cdot$cm in this embodiment) is wound and tensioned on a drive roller 101, a driven roller 102 and other rollers. Transfer device 10 is disposed under photoreceptor drum 3 with the transfer belt 103 surface put in contact with part of the outer peripheral surface of photoreceptor drum 3. This transfer belt 103 conveys paper P while pressing the paper against photoreceptor drum 3.

An elastic conductive roller 105 having a conductivity different from that of drive roller 101 and driven roller 102 and capable of applying a transfer electric field is laid out at a contact point 104 where transfer belt 103 comes into contact with photoreceptor drum 3.

Elastic conductive roller 105 is composed of a soft material such as elastic rubber, foamed resin etc. Since this elasticity of elastic conductive roller 105 permits photoreceptor drum 3 and transfer belt 103 to come into, not line contact, but area contact of a predetermined width (called a transfer nip) with each other, it is possible to improve the efficiency of transfer to the paper P that is being conveyed.

Further, a charge erasing roller 106 is disposed on the interior side of transfer belt 103, on the downstream side, with respect to the direction of paper conveyance, of the transfer area of transfer belt 103. Charge erasing roller 106 erases the electric field applied as the paper being conveyed through the transfer area so as to achieve smooth conveyance of paper P to the subsequent stage.

Also in transfer device 10, a cleaning unit 107 and a plurality of charge erasing devices 108 are provided. Cleaning unit 107 removes dirt due to leftover toner on transfer belt 103. Charge erasing devices 108 erase electricity on transfer belt 103. Erasure of charge by erasing devices 108 may be performed by grounding the transfer belt via the apparatus or by positively applying charge of a polarity opposite to that of the transfer field to the transfer belt.

The paper P with the static image (unfixed toner) transferred thereon by transfer device 10 is conveyed to fixing unit 6, where it is pressed and heated so as to fuse the unfixed toner and fix it to the paper P.

As shown in FIG. 14, fixing unit 6 includes a heat roller 6*a* and a pressing roller 6*b*. As heat roller 6*a* is rotated when the paper P is being held between these heat roller 6*a* and pressing roller 6*b*, paper P passes through and between heat roller 6*a* and pressing 6*b* while it is heated and pressed. In this process, the toner image transferred on paper P can be fused and fixed thereto.

Arranged on the downstream side of fixing unit 6 with respect to the direction of paper conveyance is a conveyance roller 16 for conveying paper P.

Heat roller 6*a* has a sheet separation claw 611, a roller surface temperature detector (thermistor) 612 and a roller surface cleaning member 613, arranged on the outer periphery thereof. A heat source 614 for heating the heat roller surface at a predetermined temperature (set fixing temperature: approximately 160 to 200 deg. C.) is provided in the inner periphery of heat roller 6*a*.

Arranged on the outer periphery of pressing roller 6*b* is a pressing member 621 which presses both ends of pressing roller 6*b* so that pressing roller 6*b* abuts heat roller 6*a* with a predetermined pressure. Also, a sheet separation claw 622 and a roller surface cleaning element 623 are provided on the outer periphery of pressing roller 6*b*, similarly to the outer periphery of heat roller 6*a*.

In this fixing unit 6, as shown in FIG. 14 the unfixed toner on the paper P being conveyed is heated and fused by heat roller 6*a*, at the pressed contact (so-called fixing nip portion) 600 between heat roller 6*a* and pressing roller 6*b*, so that the unfixed toner is fixed to the paper P by its anchoring effect to the paper P by the pressing force from heat roller 6*a* and pressing roller 6*b*.

Paper feed tray 8 (FIG. 13) can accommodate a stack of sheets (paper) to which image information will be output (printed). Paper feed tray 8 is arranged under image forming portion 14 made up of light exposure unit 1, developing unit 2, photoreceptor drum 3, charger 4, charge erasing device 41, cleaner unit 5, fixing unit 6 etc. A paper pickup roller 8*a* is disposed at an upper position on the paper delivery side of this paper feed tray 8.

This paper pickup roller 8*a* (FIG. 13) picks up paper P, sheet by sheet, from the topmost of a stack of paper stored in paper feed tray 8, and conveys the paper downstream (for convenience sake, the delivery side of paper P (the cassette side) is referred to as upstream and the direction of conveyance is referred to as downstream). That is, paper pickup roller 8*a* conveys paper P to the registration roller (also called "idle roller") 15 side in paper feed path 7.

Since the image forming apparatus 1A according to the present embodiment is aimed at performing high-speed printing operations, a multiple number of paper feed trays 8 each capable of stacking 500 to 1500 sheets of standard-sized paper P are arranged under image forming portion 14. Further, a large-capacity paper feed cassette 81 capable of storing multiple kinds of paper in large volumes is arranged at the side of apparatus 1A. Also, a manual feed tray 82 for mainly supporting printing etc. for irregular sized paper is arranged over the large-capacity paper feed cassette 81.

Paper output tray 9 is arranged on the opposite side across the apparatus from that of manual feed tray 82. It is also possible to configure such a system that instead of paper output tray 9, a post-processing machine for output paper (machine for stapling, punching and other tasks) and/or a multi-bin paper output tray etc., may be arranged as an option.

Paper feed path 7 is laid out between the aforementioned photoreceptor drum 3 and paper feed tray 8, and conveys paper P supplied from paper feed tray 8, sheet by sheet to transfer device 10. In transfer device 10 a toner image is transferred from photoreceptor drum 3 to the paper, which is conveyed to fixing unit 6. The paper with an unfixed toner image fixed thereon in fixing unit 6 is then conveyed by an inversion conveyance roller 18 and a switch back roller 19, along the paper feed paths and branch guides, set for the designated processing mode.

Next, the control system of image forming apparatus 1A according to the present embodiment will be described in detail with reference to the drawings.

Figure 15:
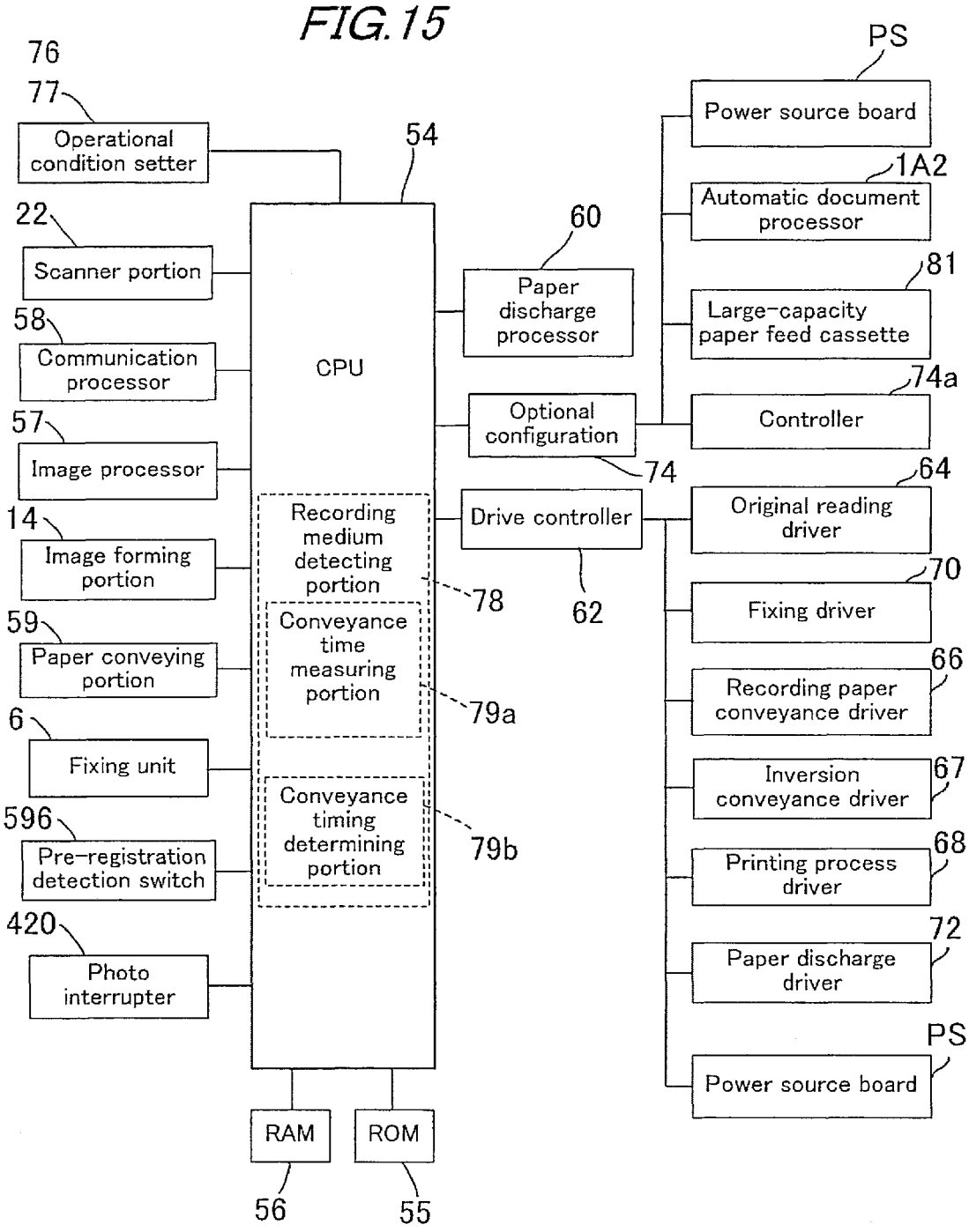
FIG. 15 is a block diagram showing an electric controller configuration of the same image forming apparatus.

FIG. 15 is a block diagram showing an electric controller configuration of the image forming apparatus according to the present embodiment.

As shown in FIG. 15, the image forming apparatus 1A according to the present embodiment performs processes such as image reading, image processing, image forming and conveyance of paper P, etc., by a central processing unit (CPU) 54 in accordance with the program stored beforehand in a ROM (read only memory) 55, using temporal storage such as a RAM (random access memory) 56 etc.

Here, it is also possible to use other storage means such as a HDD (hard disk drive) etc., instead of ROM 55 and RAM 56.

In image forming apparatus 1A, the image information of an original (original image data) captured by scanner portion 22, or original image information transmitted from other terminal devices connected on an unillustrated communication network, is adapted to be input to an image processor 57 by way of a communication processor 58.

Image processor 57 shapes the original image information stored in the storage such as RAM 56 or the like into printing image information that is suitable for printing (image forming onto paper), in accordance with the aforementioned program.

The printing image information is input to image forming portion 14.

Image forming portion 14, paper conveying portion (performing various detentions and controls of the paper in paper feed path 7 etc.), fixing unit 6 and paper discharge processor (performing various detentions and controls of the paper in paper discharge path 17) 60 are linked with respective components of drive controller 62.

The paper conveyed by a paper conveying portion 59 advances through the printing stage (the printing process of image information in image forming portion 14) and then a fixing stage (fixing unit 6) for the printed paper P and is discharged to the paper discharge portion (paper output tray 9).

Here, paper conveying portion 59 is adapted to receive detection signals from an pre-registration detection switch 596, an unillustrated fixing detection switch and paper discharge detecting switch etc.

Pre-registration detection 596 switch is a switch that detects whether the paper reaches registration roller 15. The fixing detection switch is a switch that detects whether the paper reaches fixing unit 6. The paper discharge detecting switch is a switch that detects whether the paper has been discharged.

Image forming apparatus 1A further has an operational condition setter 77.

This operational condition setter 77 sets up operational conditions for image forming and conditions of conveyance etc., in image forming apparatus 1A, in accordance with the image forming request or the image forming conditions such as the type of recording media (paper) etc., designated by the user through control switches 76.

Further, in image forming apparatus 1A, based on the set operating conditions, an original reading driver 64, a paper conveyance driver 66, an inversion conveyance driver 67, a printing process driver 68, a fixing driver 70, a paper discharge driver 72 and large-volume paper feed cassette (paper feed unit) 81 are operated following the instructions from CPU 54 in accordance with the program stored in ROM 55 so that these drivers can operate in synchronization.

Original reading driver 64 is a drive actuator for the reading portion (scan portion 22).

Paper conveyance driver 66 is a drive actuator for paper conveying portion 59, specifically, drive motors for paper pickup roller 8*a* and registration roller 15 arranged along the aforementioned paper feed path 7.

Inversion conveyance driver 67 is of drive motors for inversion conveyance roller 18 and switch back roller 19.

Printing process driver 68 is a drive actuator for image forming portion 14, transfer device 10 etc., and its example is a drive motor for photoreceptor drum 3.

Fixing driver 70 is of drive motors for heat roller 6*a* and pressing roller 6*b* in fixing unit 6.

Paper discharge driver 72 is a drive actuator for paper discharge processor 60 etc., including drive motors for paper discharge roller 17, etc.

The drive sources of the drive motors for all these drivers may be provided as common or different drive motors with appropriate power transmission mechanisms.

Further, image forming apparatus 1A may be used with optional configurations 74 including post-processors (stapler, puncher, multi-bin paper output trays, shifter, etc.), automatic document reader (automatic document processor 1A2 etc.), large-volume paper feed cassette 81 and the like. These optional configurations 74 incorporate individual controllers 74*a* separately from the controller of image forming apparatus 1A so that each processor can operate in synchronization with the main apparatus by performing timing adjustment via the aforementioned communication processor 58.

A recording medium detecting portion 78 detects arrival of the leading end of the paper at fixing unit 6 or the output portion. Specifically, recording medium detecting portion 78 includes: a conveyance time measuring portion 79*a* and a conveyance timing determining portion 79*b*.

Conveyance time measuring portion 79*a* measures the time for conveyance of the paper from when the paper is delivered from registration roller 15 at the entrance of paper feed path 7 where the paper is introduced.

Conveyance timing determining portion 79*b* determines the timings at which the paper is conveyed in paper feed path 7, based on the distances from registration roller 15 to fixing unit 6 and discharge roller 17 to be controlled, and the paper's speed of conveyance.

In this embodiment recording medium detecting portion 78 is adapted to detect the timings at which the paper arrives at (enter) fixing unit 6 and paper discharge roller 17 based on the conveyance timing of recording medium detected by conveyance timing determining portion 79*b*.

The outer peripheral sides of apparatus main body 1A1 of the thus constructed image forming apparatus 1A is covered by exterior structure 100 according to the above first embodiment shown in FIGS. 3 to 5.

In exterior structure 100 of image forming apparatus 1A, heat-radiating panels 112 are arranged at the positions where heat source (heat generating portion) 614 in fixing unit 6, the radiator of a power source board PS (FIGS. 14 and 15), paper feed path (conveyor) 7 though which print-processed paper P is conveyed and discharged, and a light source portion 22*a* of scanner portion (image reader) 22 provided in image forming apparatus 1A are located.

Power source board PS is a power source board including ICs, transformers, electronic parts and the like and supplying high voltages to drivers 64, 66, 67, 68, 70 and 72, processors 1A2, 60 and the like in accordance with the instructions from drive controller 62 and controller 74*a*. These ICs, transformers, electronic parts and the like are the heat radiating components.

Machine-interior anti-scatter panels (floating contaminant collecting panel element) 113 are arranged at the site where scatter of toner from developing unit (developing portion) 2 in image forming portion 14 occurs or at the site where cleaner unit (cleaning portion) 5 of image forming portion (process unit) 14 for forming images is located.

According to the present embodiment, shielding panels 111, heat-radiating panels 112 and machine-interior anti-scatter panels 113 are provided separately from each other, so that it is possible to construct the exterior of image forming apparatus 1A in a simple manner using framework 120 provided for the apparatus main body 1A1 side by arraying shielding panels 111, heat-radiating panels 112 and machine-interior anti-scatter panels 113 appropriately in combination in conformity with the functional configurations of image forming portion 14, fixing unit 6, scanner portion 22, cleaner unit 5 and other components in image forming apparatus 1A. Still more, since these panels are given to have an identical external configuration, it is possible to easily modify the exterior layout even when the functional configuration is altered with change of the specifications of image forming apparatus 1A.

In conclusion, according to the present embodiment, it is possible to discharge heat locally and efficiently from the areas where heat radiation is needed and locally collect floating contaminants arising in the apparatus, by changing the panel elements. Accordingly, this configuration makes it possible to provide optimal exterior layout without drastic change of the basic external structure.

As a result, it is possible to avoid image forming apparatus 1A malfunctioning due to thermal influence and produce high quality image output without letting floating contaminants arising in the apparatus from degrading the formed images and the quality of paper P to which images are transferred.

It should be noted that the present invention is not limited to the image forming apparatus illustrated in the above embodiment, and the present invention can be developed into image forming apparatus having different configurations from the present embodiment. Further, the apparatus to which the exterior structure of the present invention is applied should not be particularly limited as long as it needs air ventilation therein and collection of floating contaminants.

What is claimed is:

1. An image forming apparatus for producing image output in accordance with a print request, comprising:

an apparatus main body; and an exterior structure for covering the outside of the apparatus main body, wherein the apparatus main body includes:

an image forming portion having an electrostatic latent image support on which a developer image is formed with a developer;

a transfer unit for transferring the developer image that is developed on the electrostatic latent image support, onto a recording medium;

a fixing unit for fixing the developer image transferred on the recording medium to the recording medium; and a conveyor portion for conveying and discharging the recording medium with the developer image fixed thereon, and the exterior structure is comprised of a multiple number of panel elements for covering the outside of the apparatus main body, the multiple number of panel elements are comprised of a shielding panel element, a heat-radiating panel element and a floating contaminant collecting panel element, the shielding panel element is configured to cover the apparatus main body from the outside, the heat-radiating panel element is configured to radiate heat that is generated inside the apparatus main body, to the outside, the floating contaminant collecting panel element provides a function of collecting scattered toner and floating dust inside the apparatus main body, the multiple number of panel elements have a similar square circumference shape in its top view, each panel element has a first side edge and a second side edge which is positioned on the other side of the first side edge, the first side edge being formed in a flat section, and the second side edge being formed in an approximately L-shaped section, one and the other panel elements adjacent to each other are arranged so that the second side edge of the other panel element is fitted into an apparatus main body side of the first side edge of the one panel element, the heat-radiating panel element is disposed at a position corresponding to a heat generating portion of the fixing unit, and the floating contaminant collecting panel element is disposed at a position corresponding to the area where toner scatter of the developing portion in the image forming portion occurs or a cleaning portion of a process unit for forming images is located.

2. The image forming apparatus according to claim 1, wherein the different types of panel elements are arranged in combination in accordance with the functional configuration of the apparatus main body, and the functional configuration of the apparatus main body includes a function of radiating heat from a heat source inside the apparatus main body or a function of collecting floating contaminants inside the apparatus main body.

3. The image forming apparatus according to claim 1, wherein a framework suited to the configuration of the panel elements is arranged between the apparatus main body and the panel elements.

4. The image forming apparatus according to claim 1, wherein the heat-radiating panel element includes an air blower and at least has a ventilating hole formed on the heat-radiating panel element wall opposing the air blower.

5. The image forming apparatus according to claim 4, wherein the air blower is a suctioning fan.

6. The image forming apparatus according to claim 1, wherein the floating contaminant collecting panel includes an air blower and a contaminant collecting filter and at least has a ventilating hole formed on the floating contaminant collecting panel element wall opposing the air blower or the contaminant collecting filter.

7. The image forming apparatus according to claim 6, wherein the air blower is an exhaust fan.

8. The image forming apparatus according to claim 1, wherein the one and the other panel elements adjacent to each other are arranged so that clearances that establish communication between the interior and exterior of the apparatus are created between the first side edge of the one panel element and the second side edge of the other panel element.

* * * * *